United States Patent [19]

Albert

[11] 4,136,799

[45] Jan. 30, 1979

[54] DECANTER

[75] Inventor: Kenneth J. Albert, Beverly Hills, Calif.

[73] Assignee: Inventor's Inc., Beverly Hills, Calif.

[21] Appl. No.: 836,382

[22] Filed: Sep. 26, 1977

[51] Int. Cl.[2] ..... A47G 19/22

[52] U.S. Cl. ..... 220/415; 215/315; 220/298; 220/90.4; 222/518

[58] Field of Search ..... 215/311, 315, 313; 220/90.4, 63 R, 355, 298, 9 R, 415, 468, 453; 222/518

[56] References Cited

U.S. PATENT DOCUMENTS

| | | | |
|---|---|---|---|
| 596,244 | 12/1897 | Lied | 220/86 R |
| 1,525,032 | 2/1925 | Grady | 222/518 |
| 1,634,569 | 7/1927 | Bray | 220/298 |
| 2,447,870 | 8/1948 | Polcyn | 220/90.4 |
| 3,297,192 | 1/1967 | Swett | 220/355 |
| 3,964,631 | 6/1976 | Albert | 222/518 |
| 3,972,443 | 8/1976 | Albert | 220/378 |

*Primary Examiner*—William Price
*Assistant Examiner*—Allan N. Shoap
*Attorney, Agent, or Firm*—Dean, Flickinger & Robertson

[57] ABSTRACT

A decanter for hot or cold liquids, comprising a cylindrical receptacle having an open top and a cover detachably mounted on the receptacle at its open top. The cover consists of an upper annulus and a skirt of larger diameter than the annulus and connected thereto by a shoulder. Portions of the skirt and the annulus are spaced apart to provide a groove which receives the upper edge portion of the receptacle with a sealing fit. A top wall is integral with the annulus and is tilted with respect to a plane normal to the axis of the receptacle. This top wall is formed with a drinking opening adjacent its periphery and a relief vent diametrically opposed to the drinking opening and also adjacent to the periphery of the top wall. Depending from the inner face of the top wall and between the drinking opening and vent are a pair of spaced posts. Mounted on the ends of the posts is an operating unit comprising a bar that is substantially parallel to the top wall, a valve on one end of the bar normally closing the drinking opening, a pushbutton on the other end of the bar received in said vent and of a size smaller than the vent, an O-ring on said pushbutton normally closing the vent, with the pushbutton being disposed at an angle slightly less than 90 degrees relative to the bar, and a leaf spring having one end integral with said bar at the underside of the end carrying the pushbutton, with its other end integrally connected to a crosspiece that is mounted on the ends of the posts.

15 Claims, 16 Drawing Figures

DECANTER

The present invention relates to decanters or drinking vessels which are intended to receive either hot or cold liquids and which are characterized by the inclusion of a drinking opening and a relief vent for stream emanating from a hot drink or a gas released from a cold carbonated beverage, and is concerned primarily with such a decanter which is highly simplified as compared to known drinking vessels of this type.

BACKGROUND OF THE INVENTION

At the present time, the practice of selling hot drinks, such as coffee or tea, and colds drinks of the carbonated beverage type in fast-food restaurants, milk bars, delicatessen stores, and similar places, is becoming more and more wide-spread. Such decanters ordinarily include a receptacle of a heat-insulating material, such as an appropriate plastic, and a cover which is detachably mounted on the receptacle with a sealing fit. This cover is formed with a drinking opening adjacent its periphery and a relief vent also adjacent the periphery of the cover but positioned diametrically opposite to the drinking opening. A valve is associated with the drinking opening and a valve member carrying an O-ring with the vent.

It is highly desirable that the relief vent be opened before the drinking opening opens so as to permit the escape of steam or other gas before the drinking opening is opened.

Examples of this type of decanter or drinking vessel are disclosed in U.S. Pat. Nos. 3,967,748; 3,972,443; and 3,964,631, all issued to Kenneth J. Albert. The devices of all of these patents may be classified as providing some form of a lost-motion connection between the valve member at the relief vent and the valve at the drinking opening so that the vent is opened in advance of the drinking opening. It may be stated as a general rule that all of these patented devices are highly complex and costly to manufacture. In at least one of them, separate springs are provided for maintaining the drinking valve and valve for the relief vent normally closed.

In the application of Jody C. Numbers, Ser. No. 759,142, filed Jan. 14, 1977, for "Drinking Receptacle Valve Means," there is disclosed a decanter of this general type in which both valves are normally maintained closed by a leaf spring, with the lost-motion connection included to insure that the vent will be open in advance of the drinking opening. However, the device of this application is also somewhat complex and is costly to produce.

The present invention is founded on the belief that a decanter of the character aforesaid, which includes an operating unit having a valve member for the vent, a valve for the drinking opening, together with means for opening these valves in the required sequence order and which is highly simplified so that it may be manufactured at low cost, will meet with wide public acceptance.

OBJECTS OF THE INVENTION

With the foregoing conditions in mind, the present invention has in view the following objectives:

1. To provide a decanter comprising a receptacle of insulating material having an open top and a cover detachably mounted on said open top with a sealing fit and which cover has a drinking opening and a relief vent together with an operating unit including a valve for the drinking opening, a valve member for the relief vent, and an operating unit which provides for the relief vent being open before the drinking opening is open;

2. To provide, in a decanter of the type noted, an operating unit which includes a leaf spring having one end mounted on the underside of the cover and its other end attached to the operating unit;

3. To provide, in a decanter of the character aforesaid, an operating unit all the elements of which are of a plastic which is generally rigid but also has some properties of elasticity and resiliency;

4. To provide, in a decanter of the kind described, a cylinder receptacle which receives a liquid and which is of a plastic having good heat-insulating properties, together with a cover, which is also of plastic, and which is detachably mounted on the receptacle with a novel connecting mechanism;

5. To provide, in a decanter of the type noted, an operating unit which includes a bar that is substantially parallel to the top wall of the cover and which is formed with a valve member at one end which closes the drinking opening and a pushbutton at the other end which is received in the relief vent with a loose fit and which is disposed at an angle slightly less than 90 degrees with respect to the bar, with one end of the leaf spring being integrally connected to the bar at the end carrying the pushbutton and having its other end connected to the top wall of the cover;

6. To provide, in a decanter of the character aforesaid, mechanism for securing one end of the leaf spring to the cover, comprising a pair of spaced-apart posts which depend from the cover and the lower ends of which are secured to a crosspiece that is secured to an end of the leaf spring;

7. To provide, in a decanter of the type noted, a modified embodiment in which the leaf spring is of metal while the remaining elements of the operating unit are of plastic; and 8. To provide, in a decanter of the character described, a modified embodiment in which a seal is provided between the cover and the upper end of the receptacle by structure which does not require a gasket or packing element.

Various other more detailed objects and advantages of the invention such as arise in connection with carrying out the above-noted ideas in a practical embodiment will in part become apparent and in part be hereinafter stated as the description of the invention proceeds.

SUMMARY OF THE INVENTION

The foregoing objects are achieved by providing a decanter which consists essentially of three main parts. These are: a cylindrical receptacle having an open top; a cover which is detachably mounted on the open end of the receptacle with a sealing fit and which includes a top wall formed with a drinking opening and a relief vent; and an operating unit including valves for the drinking opening and relief vent and structure which provides for the relief vent being opened in advance of the drinking opening.

The cylindrical receptacle is of a plastic having good heat-insulating properties, and outstanding from the upper portion adjacent to the open top are a plurality of angularly spaced-apart cam ribs which constitute one part of a bayonet joint.

The cover is also of a plastic having good heat-insulating properties and comprises an upper annulus and a lower skirt which is connected to the annulus by a shoulder whereby the skirt is spaced from the lower portion of the annulus to define a groove which receives an O-ring and the upper edge portion of the receptacle. Projecting inwardly from the skirt at its lower end are a plurality of cam-shaped ribs which are spaced apart corresponding to the spacing of the ribs on the receptacle and which constitute the other part of the bayonet joint. The cover is assembled on the receptacle by passing the ribs thereon through the spaced between the ribs projecting from the receptacle and then rotating the cover in a direction which causes the cam ribs to draw the cover into sealing engagement with the upper edge of the receptacle.

The cover also includes a top wall that is integral with the upper annulus and which is tilted with respect to the vertical axis of the assembled decanter, thereby providing an annular lip, the upper edge of which is spaced from the periphery of the top wall a varying distance. This top wall is formed with a drinking opening adjacent to its periphery at which is best described as the deepest part of the top wall, and a relief vent which is diametrically opposed to the drinking opening and adjacent to the lip at which might be called the shallowest portion of the top wall. Depending from the top wall are a pair of spaced-apart posts located between the drinking opening and the relief vent and which posts have reduced end portions for connecting the spring of the operating unit thereto as will be later described.

The operating unit comprises a crosspiece which is secured to the end portions of the posts and to which one end of a leaf spring is attached. The other end of the leaf spring is connected to a bar adjacent one end thereof. The bar is disposed in a position generally parallel to the top wall of the cover. One end of the bar carries a valve member which normally closes the drinking opening while a pushbutton projects upwardly from the other end and is received in the relief vent with a loose fit. An O-ring is positioned about the pushbutton and in engagement with the bar whereby when the pushbutton is in an upraised position, the O-ring seals the space provided by the loose fit of the pushbutton in the vent.

An important feature of the invention resides in the fact that this pushbutton is disposed at an angle slightly less than 90 degrees with respect to the bar. This angle will normally range from 3–5 degrees with respect to the vertical.

In operation, the spring exerts an upward pressure on the pushbutton end of the bar to cause the O-ring thereat to close the vent and the valve member for the drinking opening is also maintained closed by the effect of the spring which is supplemented by the pressure of gas emanating from the liquid in the receptacle. In this position, the pushbutton projects above the upper face of the top wall. Upon downward pressure being applied to the pushbutton, the O-ring is moved away from the underface of the top wall to open the vent. Thus, any gas in the receptacle is released. At the same time, due to the angular disposition of the pushbutton, that portion thereof more closely adjacent to the annulus is forced against that portion of the vent more closely adjacent to the annulus. Further depression of the pushbutton creates a leverage on the bar which moves the valve member for the drinking opening into opened position. This angular relation of the pushbutton relative to the bar results in the above-described operation taking place because of balance, leverage and pressure, the pressure which is applied to the upper end of the pushbutton being effective through the leverage of the bar to move the valve member into open position against the pressure of gas within the receptacle.

In a modified embodiment, the O-ring in the cover is omitted, with the skirt and annulus being confronting frusto-conical surfaces which define the groove which receives the upper end portion of the receptacle. This upper end portion is also formed with frusto-conical surfaces which engage those of the groove so that by making the cover of a plastic which is softer than the plastic of the receptacle, the upper end portion of the receptacle may be literally wedged into the groove to provide the sealing fit.

In another modification, the bar is formed with a transverse slot-like recess. A leaf spring of metal, such as stainless steel, replaces the plastic leaf spring. One end of this spring is bent back upon itself to define a U-shape, the end of which is bent upwardly to form a flange that is snugly received in the recess. The other end of the leaf spring has the crosspiece formed integrally therewith with end portions of the crosspiece being formed with Tinnerman clips which receive end portions of the posts to mount the operating unit on the top wall of the cover.

For a full and more complete understanding of the invention, reference may be had to the following drawings, in which.

DESCRIPTION OF A PREFERRED EMBODIMENT

Figure 1:
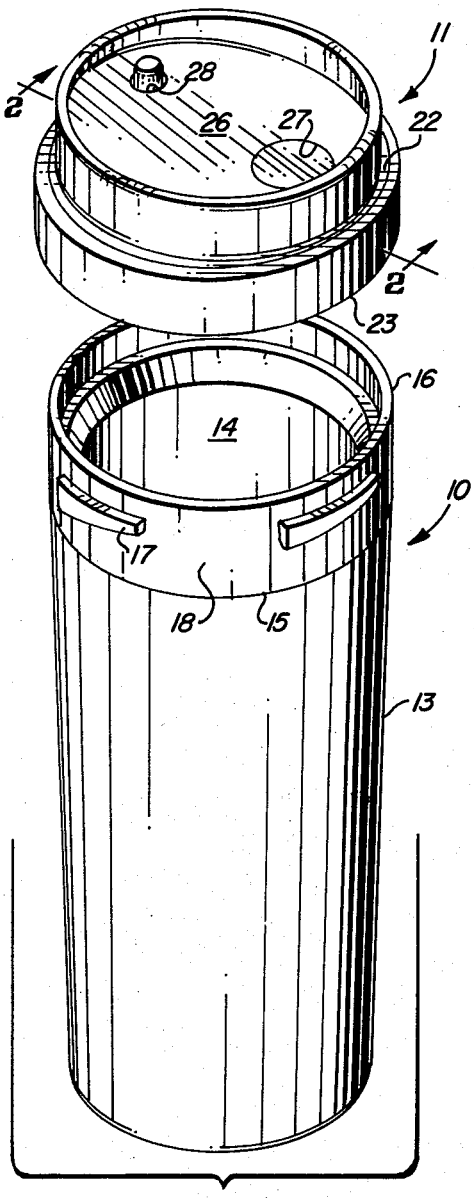
FIG. 1 is a perspective of a decanter made in accordance with the precepts of this invention and depicting the receptacle and cover in an exploded position.

Referring now to the drawings, wherein like reference characters denote corresponding parts throughout the several views, and first more particularly to FIGS. 1–4, inclusive, a receptacle for liquids is referred to in its entirety by the reference character 10, a cover designated generally 11, and an operating unit indicated generally at 12. Receptacle 10 is of a plastic having good heat-insulating properties and preferably comprises an outer layer 13 of lexan and a lining 14 of styrene. The outer layer 13 terminates at line 15 while liner 14 is expanded above line 15 to provide a ring 16 which is substantially flush with layer 13. Projecting from the outer face of ring 16 are a plurality of spaced-apart cam ribs 17, with the spaced between the ends of adjacent ribs being indicated at 18.

Cover 11 is also of a plastic having good heat-insulating properties, with styrene being a preferred material. The cover 11 comprises an upper annulus 19 having an upper edge 20 and a lower edge 21. Extending outwardly from annulus 19 between edges 20 and 21 is a flange or shoulder 22. Connected to the shoulder 22, as by a press fit, is a skirt 23 which is of the same plastic as outer layer 13, to wit, lexan. Extending inwardly from skirt 23 at its lower edge are a plurality of cam ribs 24 which are spaced apart a distance corresponding to the spacing of cam ribs 17, whereby they are adapted to pass through spaces 18 in assemblying cover 11 on receptacle 10. That portion of annulus 19 below shoulder 22 and skirt 23 cooperate with shoulder 22 in defining an annulus groove in which is positioned a gasket or packing 25. It is evident that after the cam ribs 24 have been passed through the spaces 18, the cover 11 may be rotated relative to receptacle 10 whereby cam ribs 17 and 24 cooperate to press the upper edge of ring 16 against gasket 25 and establish a liquid-tight seal between the cover and the receptacle.

Figure 2:
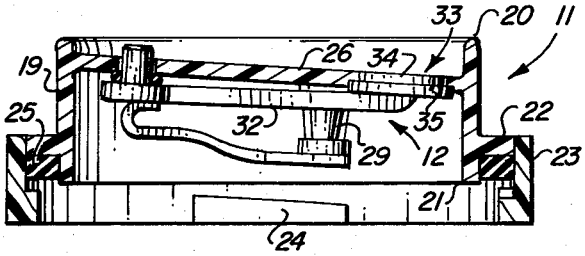
FIG. 2 is a transverse vertical section through the cover being taken about on the plane of the line 2—2 of FIG. 1.
Figure 3:
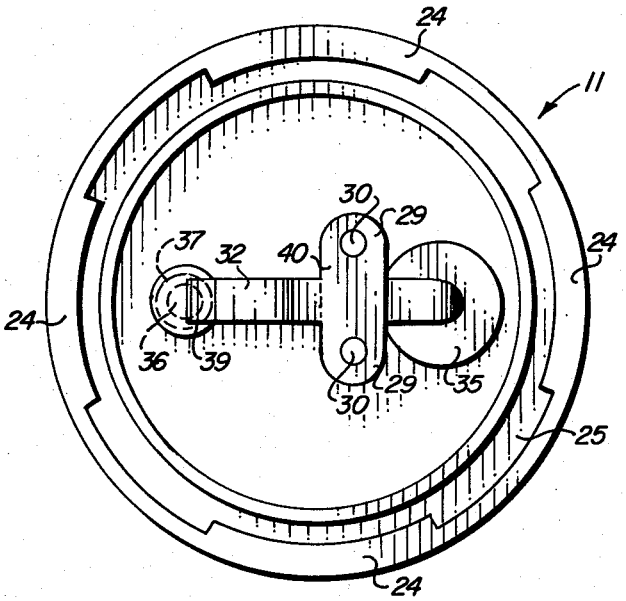
FIG. 3 is a bottom plan view of the cover per se.

As shown more clearly in FIGS. 1 and 2, cover 11 includes a top wall 26 which is canted or tilted relative to the vertical axis of the decanter when assembled. Wall 26 is formed with a drinking opening 27 which preferably is circular in shape and which is located at what might be called the deepest portion of wall 26. The latter is also formed with a circular vent 28 which is positioned diametrically opposite to opening 27 and adjacent to which might be called the shallowest part of top wall 26.

Figure 4:
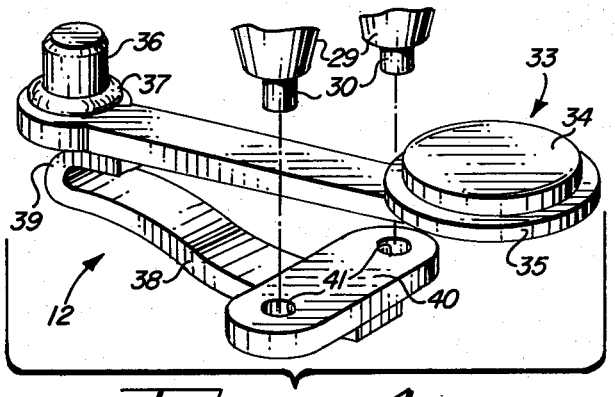
FIG. 4 is a perspective illustrating the operating unit and portions of the posts on which it is mounted on exploded relation.

Referring now more particularly to FIGS. 2 and 4, a pair of posts 29 depend from the underface of top wall 26 with which they are integral and are located between drinking opening 27 and relief vent 28, being deposed on opposite sides of a diameter which passes through opening 27 and vent 28. Posts 29 are preferably frustoconical in shape and have end portions 30.

Figure 11:
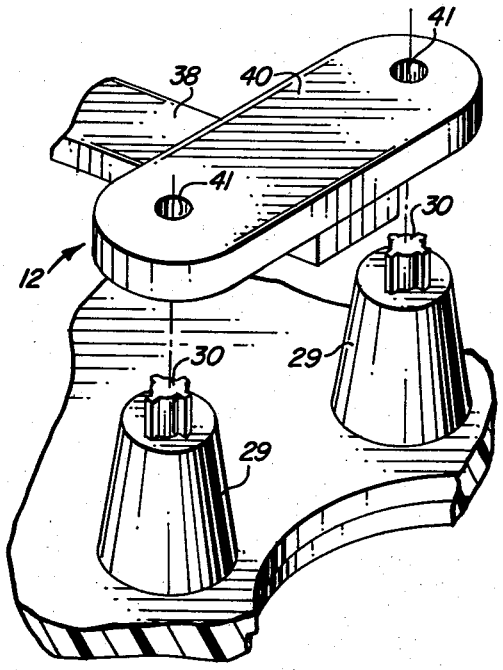
FIG. 11 is a perspective view on an enlarged scale illustrating one end of the leaf spring, the crosspiece thereon, and the mounting posts in exploded relation.
Figure 12:
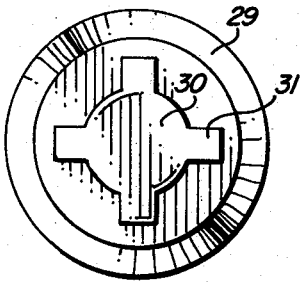
FIG. 12 is a detail plan of one of the mounting posts.

As shown in FIGS. 11 and 12, each end portion 30 is formed with four small ribs 31 which project from the outer face thereof and which are angularly spaced apart. The purpose of these ribs will later become apparent.

The operating unit 12 is best illustrated in FIG. 4. In the main embodiment it is a one-piece affair with the various elements thereof being integrally joined. It is of a plastic which is generally rigid but which has some properties of elasticity and resiliency which are better described as spring-like. Delrin, a product of the duPont Company, is a good example of such a plastic.

Referring now to FIG. 4, which may be considered along with FIG. 2, operating unit 12 comprises a bar 32 which is generally parallel as shown in FIGS. 2, 6, 7 and 8, with the parallel relation being distributed by operation of the unit. Carried by one end of bar 32 and integral therewith is a valve member 33 comprising a disk 34 which is dimensioned to be accurately received in drinking opening 27, and an abutment plate 35 which engages the underface of top wall 26 about opening 27 when the valve member 33 is in closed position.

Formed integrally with the other end of bar 32 is a pushbutton 36 which is dimensioned to be loosely received in vent 28. Encircling pushbutton 36 and engaging the upper face of bar 32 is an O-ring 37 which is dimensioned to close the space between pushbutton 36 and vent 28.

A leaf spring 38 has a U-shaped end portion 39 which is integrally joined to the underside of bar 32 adjacent to the pushbutton end of the latter. Formed integrally with the other end of spring 38 is a crosspiece 40 having end portions, each of which is formed with an aperture 41, the shape and size of which is closely related to the reduced end portions 30 of posts 29. Thus, to assemble operating unit 12 on top wall 26, crosspiece 40 is forced against posts 29 so that end portions 30 are received in apertures 41 with ribs 31 biting into the surfaces defining the apertures 41.

While it is not too clearly illustrated in the drawings, an important feature of the instant invention is the angular disposition of pushbutton 36 relative to bar 32. The angle between these two elements designated is slightly less than 90 degrees or, stating it another way, the angle between the axis of the pushbutton 36 and a line longitudinal of bar 32 should be in the range of 85 to 87 degrees.

OPERATION OF THE PREFERRED EMBODIMENT

Figure 6:
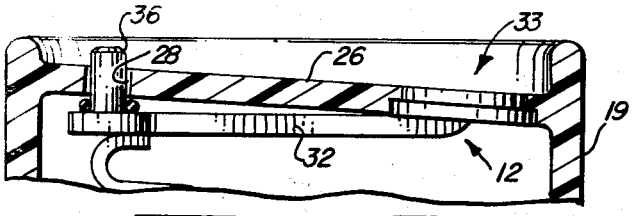
FIG. 6 is a detail transverse section taken on an enlarged scale through a portion of the upper annulus and illustrating the operating unit in position closing the drinking opening and opening the relief unit. This view is also taken about the plane of the line 2—2 of FIG. 1.

Referring now more particularly to FIGS. 2, 6, 7, 8, 13 (full lines) and 14. FIG. 2 illustrates the position of the operating unit 12 when the drinking opening 27 and relief vent 28 are fully closed. It is noted that FIG. 6 illustrates the position of the operating unit 12 when the drinking opening 27 is closed and the relief vent 28 is partially open. In this position, pushbutton 36 is spaced from the surface of vent 28 which is more closely adjacent to annulus 19.

Figure 7:
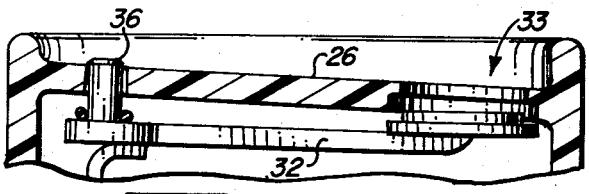
FIG. 7 is a view similar to FIG. 6 showing the position of the operating unit when the relief vent is open and the drinking valve is partially opened.
Figure 14:
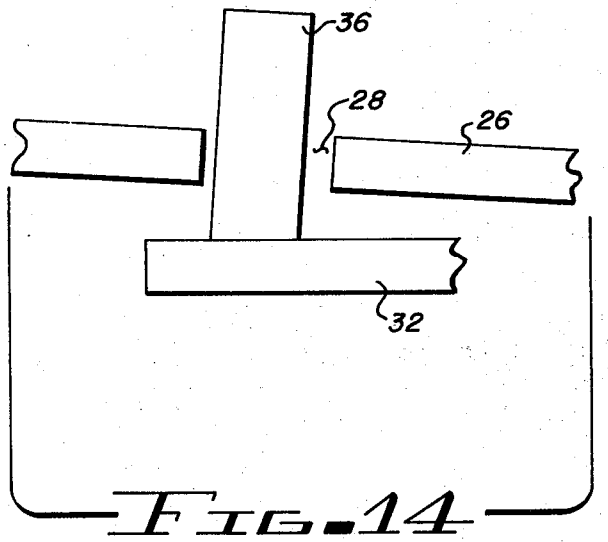
FIG. 14 is a detail diagrammatic view on an enlarged scale of the end of the valve carrying bar depicting the position of the pushbutton when the air vent is fully closed by the O-ring on the pushbutton.

Upon continued pressure being applied to the upper end of pushbutton 26, the latter will be first moved into the position of FIGS. 7 and 14. In this position, O-ring 37 is spaced from the underside of the top wall 26 and vent 28 is fully opened and drinking opening 27, partially opened, thus permitting steam or other gas to escape from the interior of the receptacle through this vent. At the same time, due to the angular inclination of pushbutton 36, it engages the surface of vent 28 more closely adjacent to annulus 19, thus providing a fulcrum for further inward movement of pushbutton 36.

Figure 8:
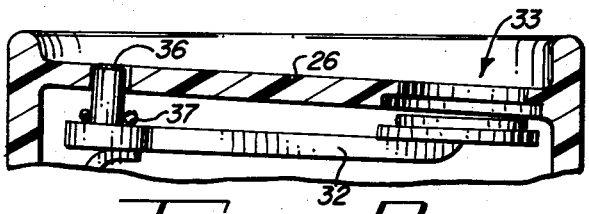
FIG. 8 is a sectional view similar to FIGS. 6 and 7, depicting the position of the operating unit when both the relief vent and the drinking valve are open.
Figure 15:
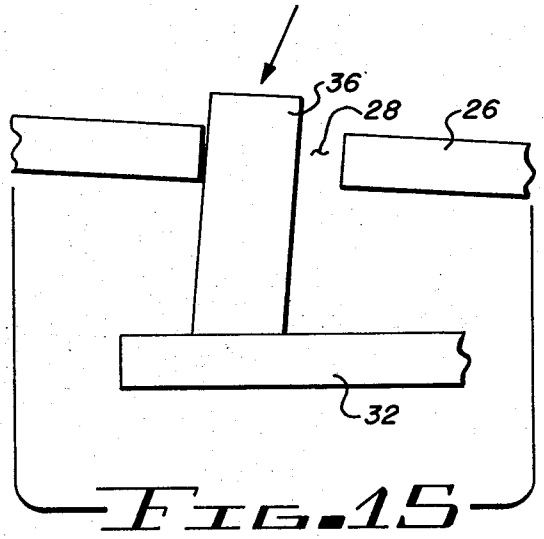
FIG. 15 is a schematic view similar to FIG. 14 showing the position of the pushbutton when the air vent is partially open.
Figure 16:
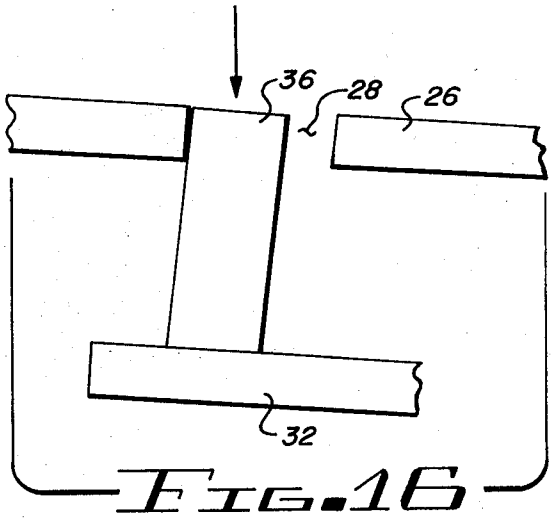
FIG. 16 is a view similar to FIGS. 14 and 15 depicting the position of the pushbutton when both valves are fully open.

It will be noted in FIGS. 7 and 15 that a portion of the pushbutton still projects above top wall 26. Further pressure on the pushbutton, which brings its ends flush with the upper surface of wall 26, is shown in FIGS. 8, 14 and 16. Thus, bar 32 is swung about this fulcrum to move valve 33 into the fully opened position of FIGS. 8, 13 and 16. The user of the decanter may now drink the contents of the receptacle by maintaining the pushbutton fully depressed.

First Modification

Figure 13:
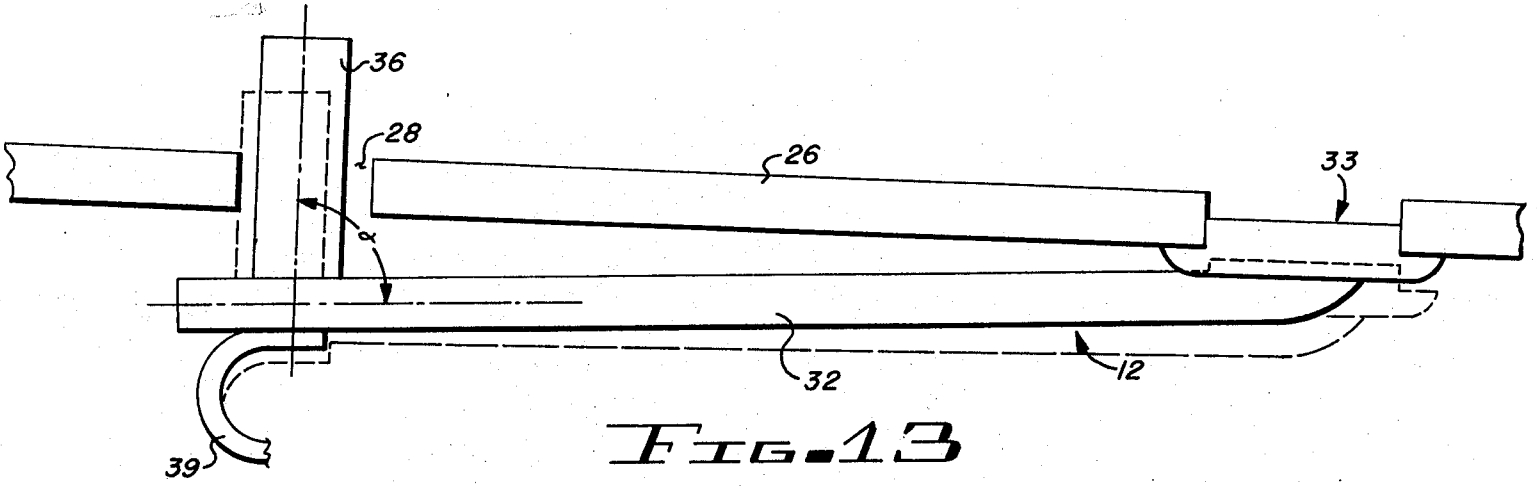
FIG. 13 is a schematic illustration looking from one side showing the valve carrying bar and valve thereon in full lines for the closed position of both valves and in dotted lines for the fully opened position of the valves. In this view, certain parts are omitted and angular relations exaggerated.

With pushbutton 36 in the partially depressed position of FIG. 15, it engages the side of vent 28 closest to the end of bar 26. Pushbutton 36 now functions as a fulcrum for swinging pushbutton 36 and bar 32 about this fulcrum in clockwise direction, speaking with reference to the showing of FIG. 13. As the lever arm provided by pushbutton 36 above this fulcum is short and the lever arm afforded by bar 32 between pushbutton 36 and valve member 33 is comparitive long, a slight further depression of pushbutton 36 will swing valve member 35 to the fully opened position as shown in FIG. 13.

Figure 5:
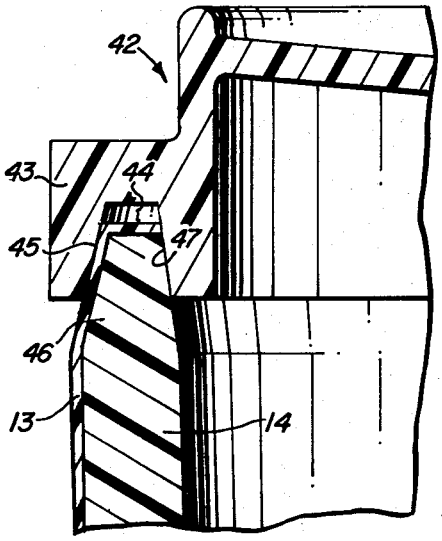
FIG. 5 is a detail section taken on an enlarged scale of a modification in which the O-ring between the cover and receptacle is omitted.

A modified form of the invention is illustrated in FIG. 5. Here the entire cover 42 is of styrene, with skirt 43 providing an annular groove 44, the side surfaces of which are conical, as illustrated at 45. The entire receptacle 46 is of lexan and its upper end portion has conical surfaces 47 which are complemental to inclined surfaces 45 on skirt 43. No gasket or packing is included and the liquid-tight seal is created merely by pressing the cover 42 onto the receptacle 46. During this action, the styrene will give slightly as it is softer than lexan, and skirt 43 will be slightly deformed so that it continuously exerts pressure on the upper edge portion of receptacle 46.

Second Modification

Figure 9:
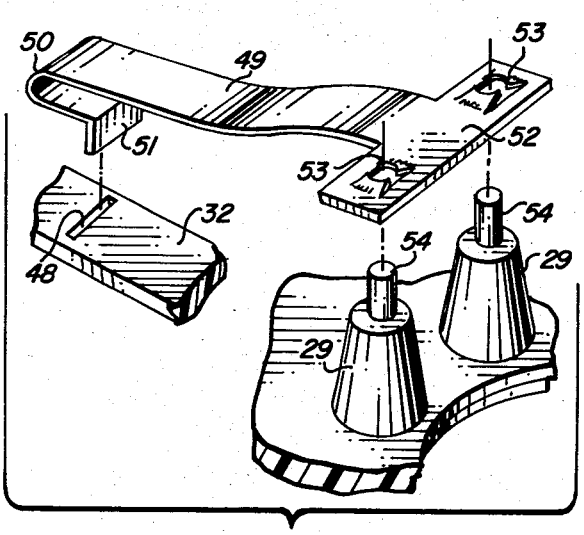
FIG. 9 is a perspective view on an enlarged scale of portions of a modified embodiment of the operating unit in which the leaf spring is of stainless steel and illustrating the respective elements in exploded relation.
Figure 10:
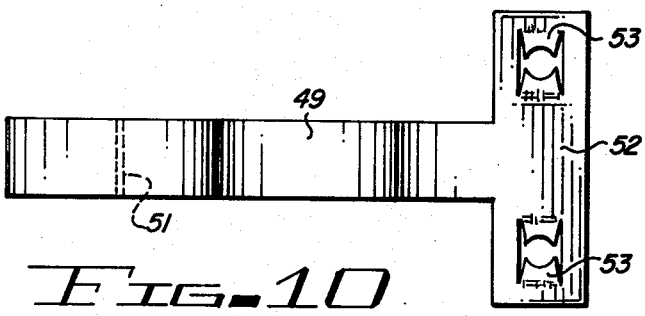
FIG. 10 is a plan view of the leaf spring per se.

A second modification is illustrated in FIGS. 9 and 10. In accordance with this modification, bar 32 is formed with a slot-like transverse recess 48 adjacent to the pushbutton end of the bar. A metallic leaf spring 49, preferably of stainless steel, has a U-shaped end portion 50 terminating in an end flange 51 which is snugly received in recess 48 to secure spring 49 to bar 32. Integral with the end of bar 49 opposite to U-shaped end 50 is a crosspiece 52, the end portions of which are formed with Tinnerman clips 53. Posts 30 have reduced end portions 54 which are truly cylindrical in that ribs 31 are omitted. The operating unit is mounted on posts 29 by forcing the Tinnerman clips 53 over the end portions 54. The clips bite into the end portions 54 in a well-known manner.

While preferred specific ebodiments of the invention have hereinbefore been set forth, it is to be clearly understood that the invention is not to be limited to the exact materials described because various modifications of these details may be provided in putting the invention into practice.

What is claimed is:

1. In a decanter for liquids from which gas emanates, an open-top cylindrical receptacle, a cover detachably mounted on said receptacle at its open top with a sealing fit, said cover including a generally vertical side wall defining a passageway confined by the perimetric boundary of said side wall, said side wall traversed by a top wall to completely block passage through said passageway, said top wall having a drinking opening and a gas relief vent, and an improved operating unit controlling opening and closing of said drinking opening and said vent, said operating unit comprising:

(a) a bar positioned on the underside of said top wall and generally parallel thereto;

(b) a valve member for said drinking opening on one end of said bar;

(c) a pushbutton on the other end of said bar and received through said vent, said pushbutton being disposed at an angle relative to said bar which is slightly less than 90 degrees on the side adjacent to the end of the bar;

(d) an O-ring about said pushbutton and engageable with the underface of said top wall to close said vent;

(e) a leaf spring having one end secured to said bar at the end having the pushbutton; and (f) means for connecting the other end of said spring to the underface of said top wall; said pushbutton being loosely positioned in said vent when said O-ring and said valve member for the drinking opening are in fully closed position; whereby upon partial depression of the pushbutton the latter engages the side of said vent closest to the end of said bar to constitute said side a fulcrum about which the pushbutton swings on further depression of the pushbutton to move said O-ring and valve member into open positions.

2. The decanter of claim 1 in which the angle between the pushbutton and the adjacent end of the bar is in the range of from 85–87 degrees.

3. The decanter of claim 1 in which the bar, valve member, pushbutton and spring are of a plastic and integrally joined together as a one-piece unit.

4. The decanter of claim 3 in which the plastic is a product of the duPont Company sold under the trademark DELRIN.

5. The decanter of claim 3 in which the means for connecting one end of the spring to the top wall takes the form of a pair of posts depending from the underface of the top wall, and a crosspiece on the end of the spring having end portions formed with apertures which receive reduced end portions of the posts.

6. The decanter of claim 5 in which each of the reduced end portions of the posts have angularly spaced ribs projecting therefrom and biting into the material of the crosspiece at the aperture in which it is received.

7. The decanter of claim 1 in which the receptacle and cover are of plastic having heat-insulating properties to a high degree.

8. The decanter of claim 7 in which the receptacle comprises an outer layer of lexan and a lining of styrene, with the lining being enlarged at the open top to provide a ring that is flush with the outer layer, and the cover comprises an annulus of styrene having upper and lower ends, a shoulder outstanding from said annulus between said upper and lower ends, and a skirt of lexan secured to and depending from said shoulder in spaced relation to the lower portion of said annulus to provide an annular groove, and a packing member in said groove.

9. The decanter of claim 8 in which the ring at the top of the receptacle is formed with a plurality of angularly spaced cam ribs on its outer surface and the skirt has a plurality of inwardly projecting cam ribs angularly spaced apart whereby they cooperate with the cam ribs on the receptacle to provide a bayonet joint.

10. The decanter of claim 1 in which the drinking opening is disposed adjacent to the periphery of the top wall and the vent is located adjacent the periphery of the top wall and diametrically opposed to said drinking opening.

11. The decanter of claim 10 in which the top wall is tilted with respect to the vertical axis of the assembled decanter, with the drinking opening being at the deepest portion of the top wall and the vent at the shallowest portion of the top wall.

12. The decanter of claim 1 in which the cover includes an annulus having a shoulder projecting therefrom and a skirt depending from the shoulder and cooperating with the latter and the annulus to define a groove having inclined side surfaces, and the receptacle has an upper end portion formed with inclined surfaces complemental to and engaging the inclined surfaces of said groove to provide the sealing fit between the receptacle and the cover.

13. The decanter of claim 1 in which the bar of the operating unit is of plastic and formed with a transverse slot-like recess and the spring is of metal having a U-shaped portion at one end terminating in a flange received in said recess.

14. The cover of claim 3 in which the means for connecting one end of the spring to the top wall comprises a crosspiece integral with said spring at the end remote from said U-shaped portion, with end portions of said crosspiece being formed with Tinnerman clips, and a pair of posts depending from said top wall and having reduced end portions in engagement with said Tinnerman clips.

15. The decanter of claim 14 in which the spring is of stainless steel.

* * * * *